US011760092B2

(12) United States Patent
Sakaida

(10) Patent No.: US 11,760,092 B2
(45) Date of Patent: Sep. 19, 2023

(54) INKJET HEAD, INKJET HEAD SUBASSEMBLY, INKJET HEAD ASSEMBLY AND INKJET PRINTER

(71) Applicant: BROTHER KOGYO KABUSHIKI KAISHA, Nagoya (JP)

(72) Inventor: Atsuo Sakaida, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 189 days.

(21) Appl. No.: 17/232,675

(22) Filed: Apr. 16, 2021

(65) Prior Publication Data

US 2021/0229444 A1 Jul. 29, 2021

Related U.S. Application Data

(63) Continuation of application No. 16/265,066, filed on Feb. 1, 2019, now Pat. No. 11,007,779, which is a (Continued)

(30) Foreign Application Priority Data

Dec. 9, 2005 (JP) ..... 2005-356628

(51) Int. Cl.
*B41J 2/05* (2006.01)
*B41J 2/045* (2006.01)
(Continued)

(52) U.S. Cl.
CPC ..... *B41J 2/14209* (2013.01); *B41J 2/155* (2013.01); *B41J 2002/14217* (2013.01);
(Continued)

(58) Field of Classification Search
CPC ..... B41J 2/14201; B41J 2/14; B41J 2/14233; B41J 2/161; B41J 2/14032; B41J 2/1404;
(Continued)

(56) References Cited

U.S. PATENT DOCUMENTS 4,357,614 A 11/1982 Tamai
5,790,155 A 8/1998 Usui et al.
(Continued)

FOREIGN PATENT DOCUMENTS

EP 0426473 A2 5/1991
EP 0820871 A2 1/1998
(Continued)

OTHER PUBLICATIONS

Japan Patent Office, Notification of Reasons for Refusal for Japanese Patent Application No. 2005-356628, dated Feb. 9, 2010.
(Continued)

*Primary Examiner* — Kaveh C Kianni
*Assistant Examiner* — Hung Q Lam
(74) *Attorney, Agent, or Firm* — Merchant & Gould P.C.

(57) ABSTRACT

An inkjet head including a flow path unit and a plurality of actuator units, each of the plurality of actuator units has a parallelogram shape defined by two sets of opposing sides, which is substantially parallel to a first direction and a second direction intersecting with each other along a plane, the side of the actuator unit parallel to the second direction is substantially parallel to that of an adjacent actuator unit and is shifted from that of the adjacent actuator unit in the second direction, the plurality of actuator units are inclined with respect to two contour lines of a flow path unit, the two contour lines being parallel with each other and extending in a longitudinal direction of the flow path unit, and centers of gravity of contours of the plurality of actuator units are arranged on substantially one straight line which is parallel to the contour lines.

6 Claims, 9 Drawing Sheets

Related U.S. Application Data continuation of application No. 15/943,355, filed on Apr. 2, 2018, now Pat. No. 10,232,614, which is a continuation of application No. 11/567,910, filed on Dec. 7, 2006, now Pat. No. 9,956,775.

(51) Int. Cl.
*B41J 2/175* (2006.01)
*B41J 2/14* (2006.01)
*B41J 2/155* (2006.01)

(52) U.S. Cl.
CPC ..... *B41J 2002/14225* (2013.01); *B41J 2002/14306* (2013.01); *B41J 2002/14459* (2013.01); *B41J 2002/14491* (2013.01); *B41J 2202/20* (2013.01)

(58) Field of Classification Search
CPC ..... B41J 2/1607; B41J 2/1621; B41J 2/1618; B41J 2/14209
USPC ... 347/20, 44, 47, 54, 65, 68, 70–72, 84, 85
See application file for complete search history.

(56) References Cited

U.S. PATENT DOCUMENTS

| | | | |
|---|---|---|---|
| 6,042,223 | A | 3/2000 | Katakura |
| 6,220,698 | B1 | 4/2001 | Katakura |
| 6,371,601 | B1 | 4/2002 | Katakura |
| 6,767,083 | B2 | 7/2004 | Zhang |
| 6,779,871 | B1 | 8/2004 | Seto et al. |
| 6,808,254 | B2 | 10/2004 | Sakaida et al. |
| 2001/0033313 | A1 | 10/2001 | Ohno et al. |
| 2003/0122902 | A1 | 7/2003 | Sakaida et al. |
| 2004/0130604 | A1 | 7/2004 | Watanabe et al. |
| 2005/0001877 | A1 | 1/2005 | Chikanawa et al. |
| 2005/0036006 | A1 | 2/2005 | Watanabe |
| 2005/0068380 | A1 | 3/2005 | Ito |
| 2005/0140754 | A1 | 6/2005 | Hirota et al. |
| 2005/0212875 | A1 | 9/2005 | Kodama |
| 2005/0231554 | A1 | 10/2005 | Sakaida et al. |
| 2006/0066685 | A1 | 3/2006 | Sugahara |
| 2006/0132550 | A1 | 6/2006 | Sugahara |

FOREIGN PATENT DOCUMENTS

| | | | |
|---|---|---|---|
| EP | 1338419 | A1 | 8/2003 |
| JP | H09-187932 | A | 7/1997 |
| JP | H10-34923 | A | 2/1998 |
| JP | 10-217452 | | 8/1998 |
| JP | 2001-334674 | A | 12/2001 |
| JP | 2003-118109 | A | 4/2003 |
| JP | 2004-114342 | A | 4/2004 |
| JP | 2005-306017 | A | 11/2005 |

OTHER PUBLICATIONS

European Patent Office, European Office Action for European Patent Application No. EP06025348, dated Jul. 14, 2008.
European Patent Office, European Search Report for European Patent Application No. EP06025348, dated Dec. 3, 2007.

SECOND DIRECTION
SHEET WIDTH DIRECTION
SHEET CONVEYING DIRECTION
5b
8
10
5b
12
10
10
9
5b
10
5b
10
8
10
8
10
8

INKJET HEAD, INKJET HEAD SUBASSEMBLY, INKJET HEAD ASSEMBLY AND INKJET PRINTER

CROSS-REFERENCE TO RELATED APPLICATION

This application is a Continuation of U.S. patent application Ser. No. 16/265,066, filed Feb. 1, 2019, now U.S. Pat. No. 11,007,779, which is a continuation of Ser. No. 15/943,355, filed on Apr. 2, 2018, now U.S. Pat. No. 10,232,614, which is a Continuation of U.S. patent application Ser. No. 11/567,910, filed on Dec. 7, 2006, now U.S. Pat. No. 9,956,775, which claims priority from Japanese Patent Application No. 2005-356628, filed on Dec. 9, 2005, and which applications are incorporated herein by reference. To the extent appropriate, a claim of priority is made to each of the above disclosed applications.

TECHNICAL FIELD

Aspects of the present invention relate to an inkjet head which ejects an ink from an ink ejection port, an inkjet head subassembly, an inkjet head assembly and an inkjet printer.

BACKGROUND

Some inkjet heads having a relatively long shape and ejecting an ink from nozzles to perform printing have a plurality of actuator units, each actuator units being placed on a surface of a flow path unit. JP-A-10-217452 (FIG. 1) discloses an inkjet head having four actuator units which have a parallelogram-like contour in a plan view. Each actuator units has a same structure and is placed on the surface of a flow path unit such that one set of opposing sides of a parallelogram is substantially parallel to a contour line of the flow path unit. Adjacent actuator units are shifted from each other by a predetermined distance in one direction. According to such configuration, even when the inkjet head is prolonged, it is not necessary to make the actuator units themselves long. Therefore, fabrication yield of the actuator units may be prevented from lowering.

SUMMARY

The actuator units disclosed in JP-A-10-217452 are placed on the inkjet head being shifted in one direction. In case where the inkjet head is prolonged and a large number of actuator units are disposed, a length of the flow path unit in a direction perpendicular to a longitudinal direction may become large. Thus, the size of a plan shape of the inkjet head may be increased.

Aspects of the invention provide an inkjet head in which, even when the inkjet head is prolonged, the plan shape can be made small, an inkjet head subassembly having a plurality of such inkjet heads, an inkjet head assembly having a plurality of such inkjet head subassemblies and an inkjet printer having a plurality of such inkjet heads.

According to a first aspect of the invention, an inkjet head comprises: a flow path unit including: a plurality of pressure chambers which communicate with respective ink ejection ports and are arranged in a matrix pattern in a first direction and a second direction which are intersecting with each other along a plane; a common ink chamber which communicates with the plurality of pressure chambers; and an ink supply port which supplies an ink to the common ink chamber; and a plurality of actuator units which are placed on one surface of the flow path unit parallel to the plane and apply a pressure to the ink in the plurality of pressure chambers, the plurality of actuator units being driven to eject the ink from the ink ejection ports, wherein: each of the plurality of actuator units has a parallelogram shape defined by two sets of opposing sides, the two sets of opposing sides being substantially parallel to the first and second directions, respectively; the side of the actuator unit parallel to the second direction is substantially parallel to that of an adjacent actuator unit and is shifted from that of the adjacent actuator unit in the second direction; the plurality of actuator units are inclined with respect to two contour lines of the flow path unit, the two contour lines being parallel with each other and extending in a longitudinal direction of the flow path unit; and centers of gravity of contours of the plurality of actuator units are arranged on substantially one straight line which is parallel to the contour lines.

According to a second aspect of the invention, an inkjet printer comprising the inkjet head according to the first aspect and performing printing on a recording medium conveyed in a predetermined conveying direction, wherein the inkjet head is placed such that the first direction and the conveying direction are substantially perpendicular to each other, and wherein a plurality of projection points, which are obtained by projecting the plurality of ink ejection ports of the plurality of pressure chambers in the conveying direction onto a virtual straight line which is perpendicular to the conveying direction, are arranged at substantially equal intervals on the virtual straight line.

According to a third aspect of the invention, an inkjet printer comprising the inkjet head according to the first aspect and performing printing on a recording medium conveyed in a predetermined conveying direction, wherein the inkjet head is placed such that the contour lines of the flow path unit and the conveying direction are substantially perpendicular to each other, and wherein a plurality of projection points, which are obtained by projecting the plurality of ink ejection ports of the plurality of pressure chambers in the conveying direction onto a virtual straight line which is perpendicular to the conveying direction, are arranged at substantially equal intervals on the virtual straight line.

According to a fourth aspect of the invention, an inkjet head subassembly of the invention comprises: a plurality of inkjet heads according to the first aspect; and a fixing member which fixes the plurality of inkjet heads, wherein the plurality of inkjet heads are arranged on a surface of the fixing member along a third direction which intersects with the first direction, the second direction, and the contour lines.

According to a fifth aspect of the invention, an inkjet head assembly comprising a plurality of inkjet head subassemblies according to the fourth aspect, the plurality of inkjet head subassemblies are arranged along a fourth direction which intersects with the first direction, the second direction, the third direction and the contour lines.

According to a sixth aspect of the invention, an inkjet printer comprising the inkjet head assembly according to the fifth aspect and performing printing on a recording medium conveyed in a predetermined conveying direction, wherein the inkjet head assembly is placed such that the fourth direction and the conveying direction are substantially perpendicular to each other.

DETAILED DESCRIPTION

Illustrative Embodiments

First Embodiment

Figure 1:
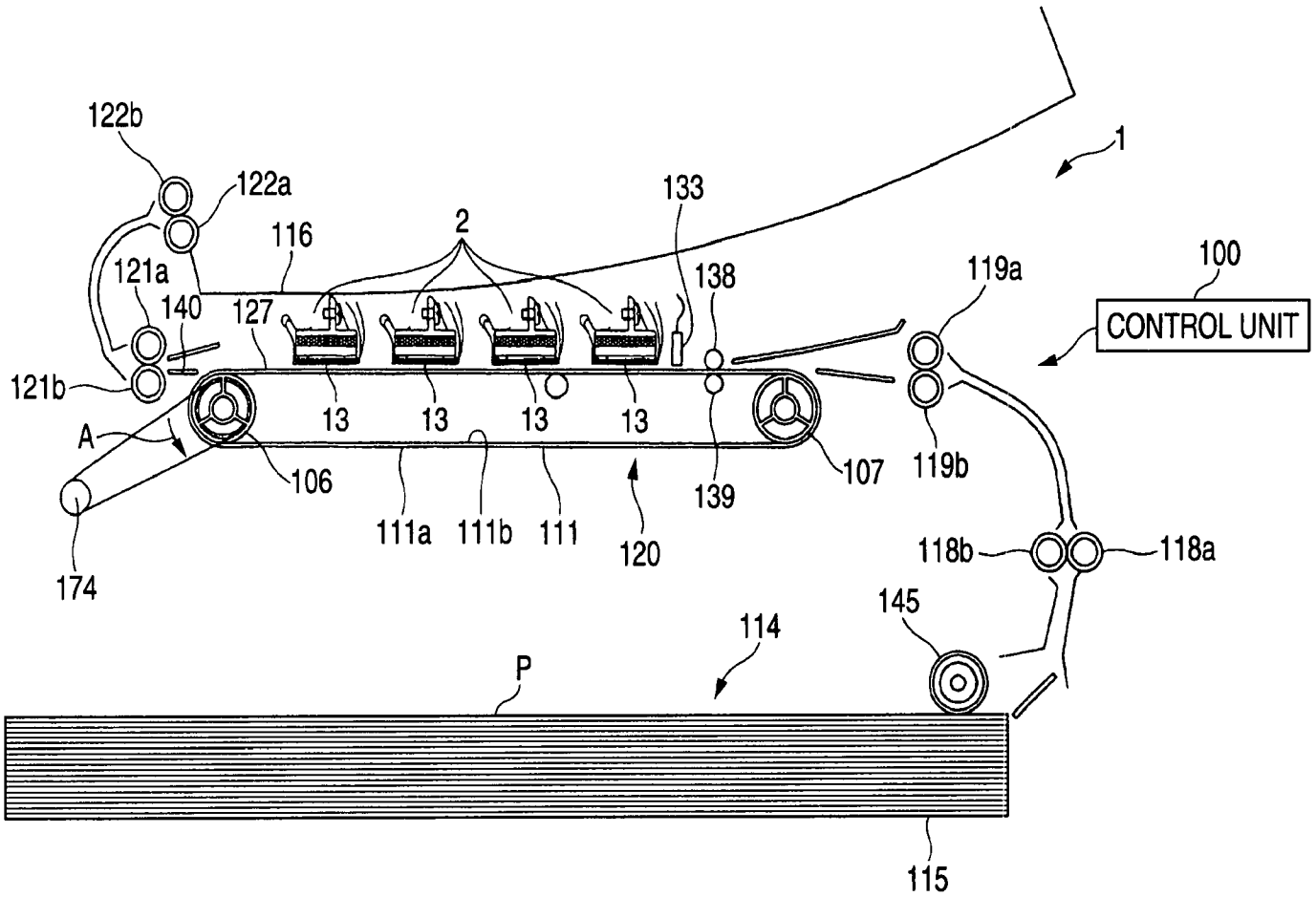
FIG. 1 is a diagram of the configuration of an inkjet printer of a first aspect.

First, an inkjet head of a first embodiment of the invention will be described. FIG. 1 shows a printer 1 including inkjet heads 2. The printer 1 shown in FIG. 1 is a line-head type color inkjet printer having the four fixed inkjet heads 2 which are elongated in a plan view in the direction perpendicular to the plane of the paper in FIG. 1. In the printer 1, a sheet feed section 114 is disposed at the lower side of the figure, a sheet discharge tray 116 in the upper side of the figure, and a conveying unit 120 in the middle of the figure. The printer 1 further comprises a control unit 100 which controls the operations of the components.

The sheet feed section 114 has a sheet housing portion 115 which can house a plurality of stacked rectangular printing sheets (recording media) P and a sheet feed roller 145 which feeds out one by one the printing sheet P that is the uppermost one in the sheet housing portion 115. The printing sheets P are housed in the sheet housing portion 115 in such a manner that the printing sheets are supplied in a direction parallel to their long sides. Two pairs of feed rollers 118*a*, 118*b* and 119*a*, 119*b* are placed along the conveying path between the sheet housing portion 115 and the conveying unit 120. The printing sheet P discharged from the sheet feed section 114 is fed toward the upper side in FIG. 1 by the feed rollers 118*a* and 118*b* while its one short side is set as a leading end. Thereafter, the printing sheet is fed leftward (in the sheet conveying direction) toward the conveying unit 120 by the feed rollers 119*a* and 119*b*.

The conveying unit 120 comprises an endless conveying belt 111 and two belt rollers 106 and 107 around which the conveying belt 111 is wound. The conveying belt 111 is adjusted so as to have a length at which a predetermined tension is generated in the conveying belt 111 wound around the two belt rollers 106 and 107. The conveying belt 111 is wound around the two belt rollers 106 and 107. Thus, two planes, which are parallel to each other and include common tangential lines of the belt rollers 106 and 107, are formed on the conveying belt 111. In the two planes, the plane which is opposed to the inkjet heads 2 functions as a conveying surface 127 for the printing sheet P. The printing sheet P which is fed out from the sheet feed section 114 is conveyed on the conveying surface 127 formed by the conveying belt 111 while printing is being performed on the upper face (printing face) by the inkjet heads 2, and reaches the sheet discharge tray 116. A plurality of printing sheets P on which printing has been performed are placed on the sheet discharge tray 116 in a stacked manner.

Each of the four inkjet heads 2 has a head body 13 at its lower end. The head body 13 has a configuration in which four actuator units 21 are bonded to a flow path unit 4 by an adhesive agent. The actuator units 21 can apply a pressure to inks in desired ones of pressure chambers 10. Individual ink flow paths 32 including the pressure chambers 10 communicating with nozzles 8 are formed in the flow path 4 (see FIG. 4). Flexible Printed Circuits (FPCs) 7 through which a print signal is supplied are bonded to each of the actuator units 21 (see FIG. 2).

The four head bodies 13 are placed in close proximity to one another along the lateral direction of FIG. 1. Nozzles 8 having a minute diameter are disposed in the lower faces (ink ejection faces) of the four head bodies 13 (see FIG. 3). The color of the inks ejected from the nozzles 8 is one of magenta (M), yellow (Y), cyan (C) and black (B). The nozzles 8 belonging to one head body 13 eject inks of the same color. The nozzles 8 provided to the four head bodies 13 eject inks of different colors selected from the four colors of magenta, yellow, cyan and black.

A small gap is formed between the lower faces of the head bodies 13 and the conveying surface 127 of the conveying belt 111. The printing sheet P is conveyed from the right side of FIG. 1 to the left side along the conveying path which passes through the gap. When the printing sheet P passes sequentially under the four head bodies 13, inks are ejected toward the upper face of the printing sheet P from the nozzles 8 in accordance with image data. Accordingly, desired color image is formed on the printing sheet P.

The two belt rollers 106 and 107 are in contact with the inner peripheral face 111*b* of the conveying belt 111. In the two belt rollers 106 and 107 of the conveying unit 120, the belt roller 106 which is positioned downstream of the conveying path is coupled with a conveying motor 174. The conveying motor 174 is rotatingly driven on the basis of the control of the control unit 100. The other belt roller 107 is a driven roller which is rotated by the rotational force given from the conveying belt 111 in accordance with the rotation of the belt roller 106.

A nip roller 138 and a nip-receiving roller 139 are placed in the vicinity of the belt roller 107 so as to sandwich the conveying belt 111. The nip roller 138 is downward urged by a spring (not shown) so that the printing sheet P supplied to the conveying unit 120 can be pressed against the conveying surface 127. The nip roller 138 and the nip-receiving roller 139 nip the printing sheet P together with the conveying belt 111. The outer peripheral face of the conveying belt 111 is treated with adhesive silicon rubber. Accordingly, the printing sheet P is surely adhered to the conveying surface 127.

A separation plate 140 is disposed on the left side of the conveying unit 120 in FIG. 1. The right end of the separation plate 140 enters between the printing sheet P and the conveying belt 111. Thus, the printing sheet P adhered to the conveying surface 127 of the conveying belt 111 is peeled from the conveying surface 127.

Two pairs of feed rollers 121*a*, 121*b* and 122*a*, 122*b* are placed between the conveying unit 120 and the sheet discharge tray 116. The printing sheet P discharged from the conveying unit 120 is fed toward the upper side in FIG. 1 by the feed rollers 121*a* and 121*b* while its one short side is set as the leading end. The printing sheet P is fed toward the sheet discharge tray 116 by the feed rollers 122*a* and 122*b*.

In order to detect the leading end of the printing sheet P on the conveying path, a sheet face sensor 133 is placed between the nip roller 138 and the inkjet head 2 in the extreme upstream side. The sheet face sensor 133 is an optical sensor configured by a light-emitting element and a light-receiving element.

Figure 2:
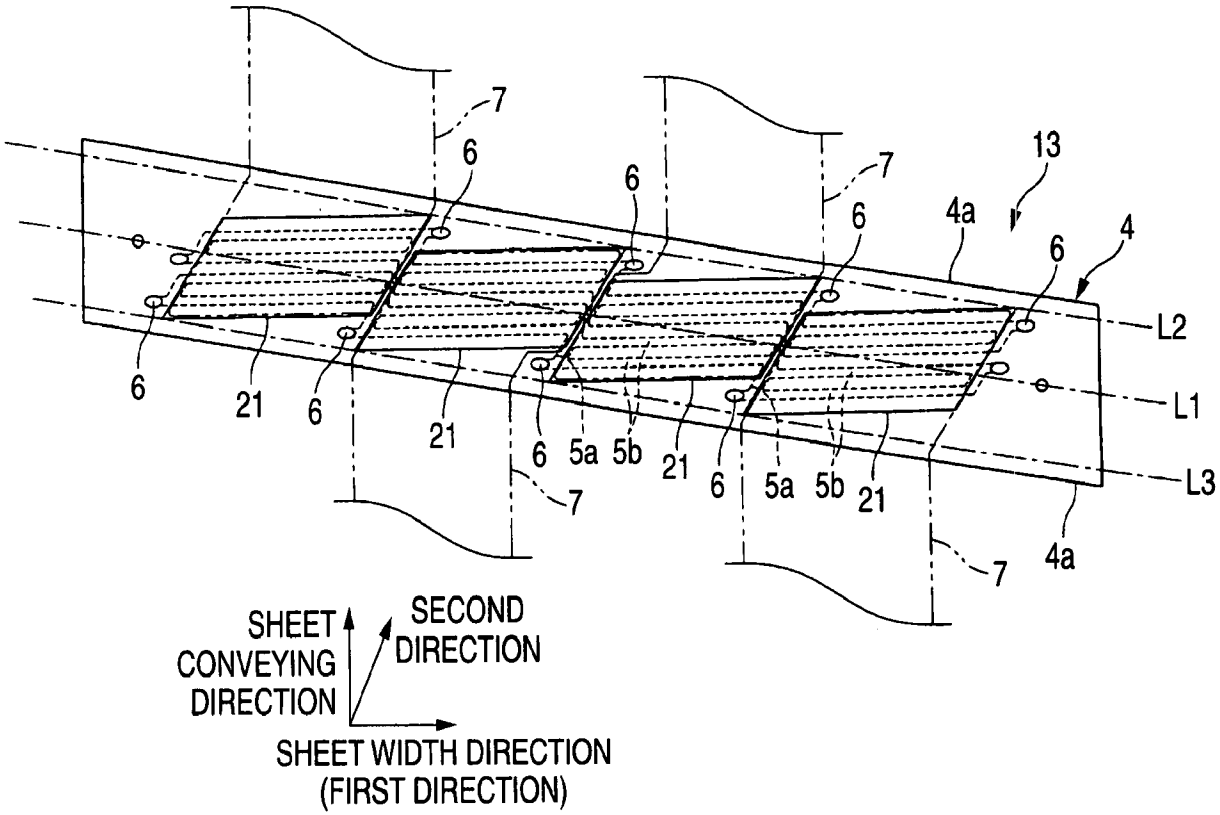
FIG. 2 is a plan view of a head body of FIG. 1.
Figure 3:
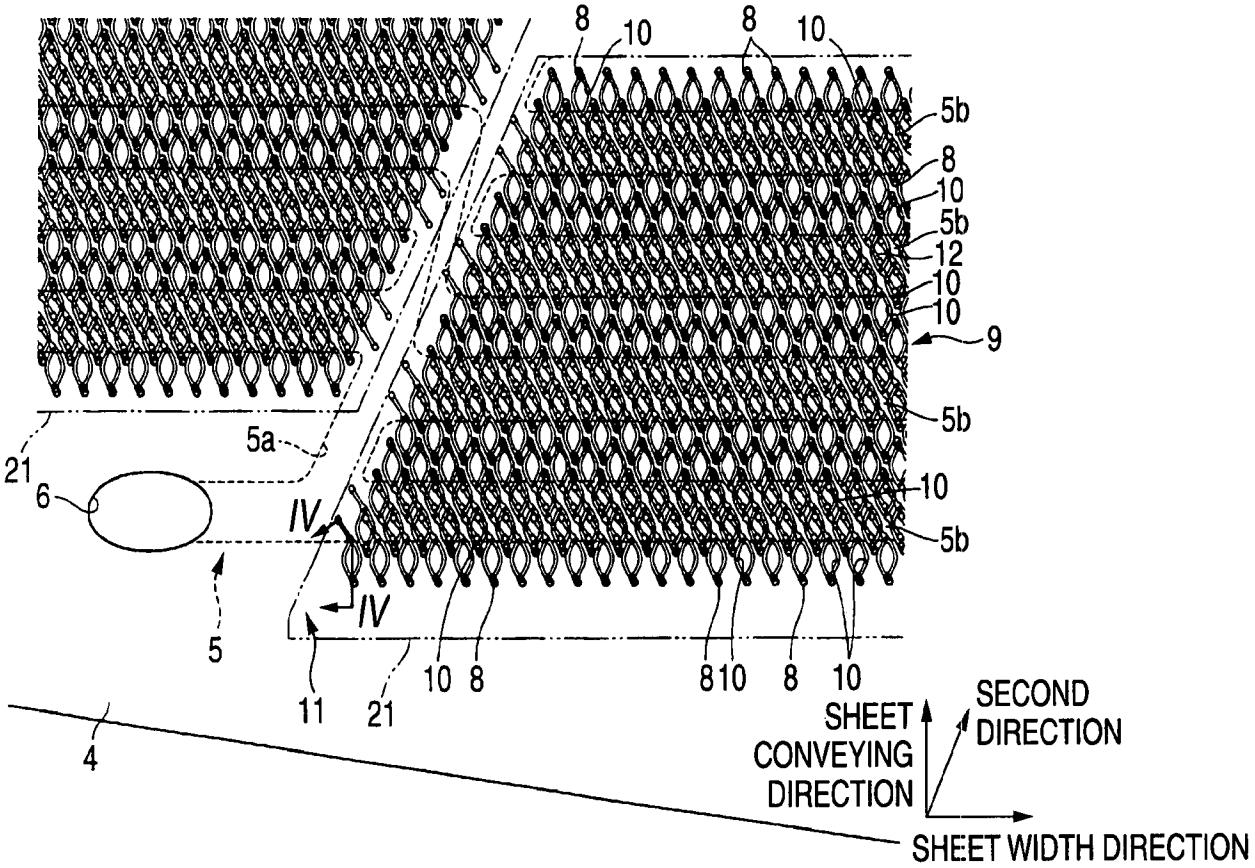
FIG. 3 is a partial enlarged view of FIG. 2.
Figure 4:
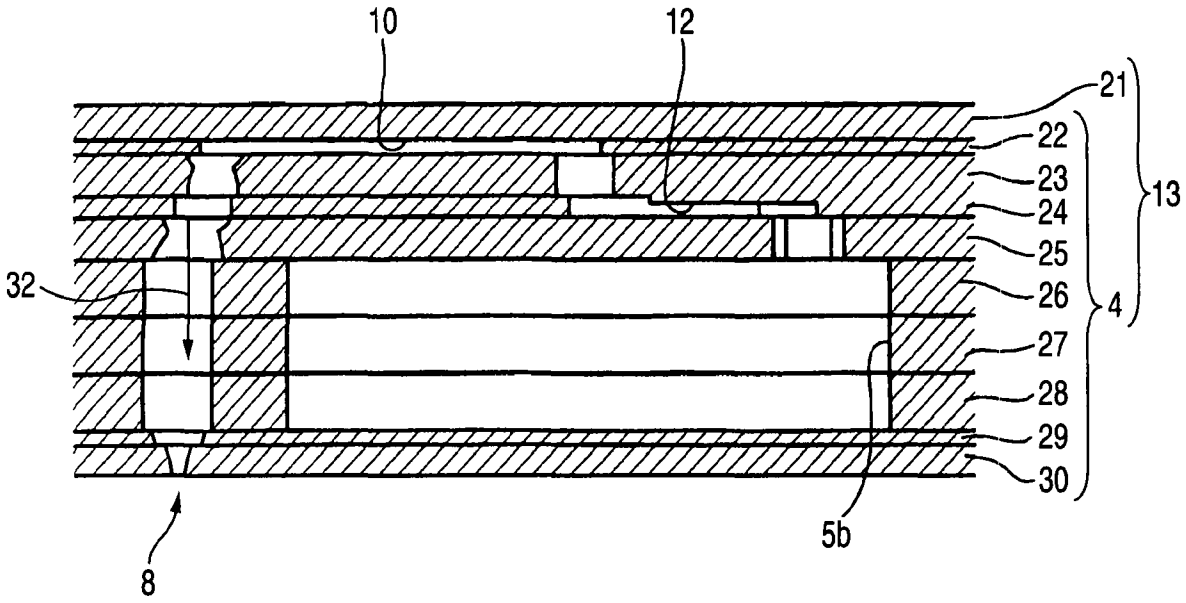
FIG. 4 is a section view taken along the line IV-IV of FIG. 3.
Figure 5A:
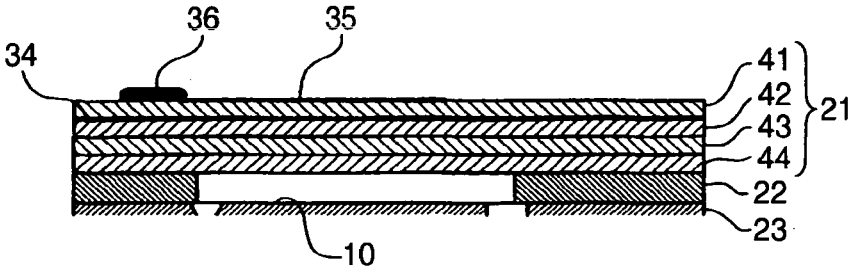
FIG. 5A is an enlarged view of the vicinity of an actuator unit of FIG. 4.
Figure 5B:
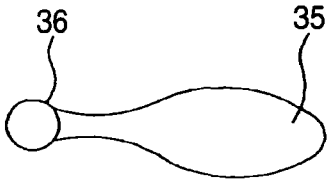
FIG. 5B is an enlarged plan view of an individual electrode of FIG. 5A.

The head body 13 will be described in detail with reference to FIGS. 2 to 5. FIG. 2 is a plan view of the head body 13 shown in FIG. 1. FIG. 3 is a partial enlarged view of FIG. 2. FIG. 4 is a section view taken along the line IV-IV of FIG. 3. FIG. 5A is a partial enlarged view of the vicinity of the actuator unit 21 of FIG. 4. FIG. 5B is an enlarged plan view of an individual electrode 35 of FIG. 5A. In FIG. 2, for the sake of convenience in description, the FPCs 7 which are originally in the uppermost surface layer and therefore to be indicated by solid lines are indicated by two-dot chain lines. The actuator units 21 which are not seen because they are covered by the FPCs 7 are indicated by solid lines.

As shown in FIGS. 2 and 3, the head body 13 has the flow path unit 4 in which the pressure chambers 10 and the nozzles 8 are formed. The pressure chambers 10 constitutes four pressure chamber groups 9. The nozzles 8 communicates with the pressure chambers 10 are formed. The four actuator units 21 which have a substantially parallelogram-like contour in a plan view are bonded to the upper face of the flow path unit 4. The long sides of a parallelogram which define the contour of each actuator unit 21 (hereinafter referred to as the long sides of the contour of the actuator unit 21, or the like) are inclined with respect to longitudinal contour lines 4*a* of the flow path unit 4. The actuator units are placed such that the long sides are parallel to the sheet width direction (the lateral direction of FIG. 2, a first direction) perpendicular to the sheet conveying direction (the vertical direction of FIG. 2). The actuator units are placed so that the short sides of adjacent ones of the actuator units 21 are shifted in a direction (second direction) parallel to the short sides. The centers of gravity of the contours of the four actuator units 21 are positioned on a straight line L1 which is parallel to the contour lines 4*a* of the flow path unit 4. According to the configuration, the four actuator units 21 can be disposed within the range between straight lines L2 and L3 with respect to the direction perpendicular to the contour lines 4*a*. When this arrangement is employed, the plurality of actuator units 21 can be disposed within the range between straight lines L2 and L3 irrespective of the number of the actuator units 21. Even when the number of the actuator units 21 is increased, it is not necessary to prolong the length of the flow path unit 4 in the direction perpendicular to the contour lines 4*a*. Accordingly, the plan shape of the head body 13 can be made small. As shown in FIG. 2, the flow path unit 4 as a whole has a parallelogram-like contour shape. The short sides of the parallelogram obliquely intersect with the long sides and are parallel to the sheet conveying direction when the head body 13 is mounted on the printer body (printer main unit).

The FPCs 7 are placed on the upper faces of the four actuator units 21, respectively. As shown in FIG. 2, the four FPCs 7 are led out alternately in opposite directions with respect to the sheet conveying direction (the vertical direction of FIG. 2). Among the four FPCs 7, the two FPCs placed at the both ends with respect the sheet width direction (the lateral direction of FIG. 2) extend at the same width from the upper faces of the actuator units 21. On the other hand, in the two FPCs placed inside with respect the sheet width direction, the widths of the portions which do not overlap with the corresponding actuator units 21 in a plan view are made smaller than those of the portions which overlap with the actuator units 21 in order to avoid ink supply ports 6, which are formed along the two contour lines 4*a* of the flow path unit 4.

The lower face of the flow path unit 4 which is opposed to the adhesion region of the actuator unit 21 is configured as an ink ejection region. As shown in FIG. 3, the nozzles 8 are regularly arranged in the surface of the ink ejection region. More specifically, a plurality of nozzles 8 are arranged with respect to the sheet width direction to form a nozzle row 8*a*. A plurality of nozzle rows 8*a* are arranged along the second direction.

In the upper face of the flow path unit 4, the pressure chambers 10 are arranged in a matrix pattern so as to respectively correspond to the nozzles 8 formed in the lower face. In the upper face of the flow path unit 4, a plurality of pressure chambers 10 constitute one pressure chamber group 9 in the region opposed to the adhesion region of one actuator unit 21. As described later, one individual electrode 35 formed on the actuator unit 21 is opposed to each pressure chamber 10. The ink ejection region and a region which is occupied by the pressure chamber group 9 have a contour shape similar to the corresponding actuator unit 21.

A common ink chamber 5 including a manifold flow path (main ink chamber) 5*a* and submanifold flow paths (branch ink chambers) 5*b* is formed in the flow path unit 4. An ink is supplied from the ink supply port 6 disposed in the upper face of the flow path unit 4 to the manifold flow path 5*b*. The submanifold flow paths 5*b* are branched from the manifold flow path 5*a* to distribute the ink to the pressure chambers 10. The manifold flow path 5*a* extends in the second direction in the vicinities of regions between adjacent ones of the actuator units 21 in a plan view and in regions which overlap with the vicinities of outer end portions of the two actuator units 21 formed at both ends with respect to the sheet width direction. The submanifold flow paths 5*b* are branched toward the both sides with respect to the sheet width direction from portions of the manifold flow path 5*a* formed in the vicinities of regions between adjacent ones of the actuator units 21. The submanifold flow paths 5*b* are branched toward the inner side of the flow path unit 4 with respect to the sheet width direction from portions of the actuator units 21 formed in the vicinities of outer end portions. The plurality of submanifold flow paths 5*b* extend in the sheet width direction and are arranged at equal intervals along the second direction.

The nozzles 8 communicate with the submanifold flow paths 5*b* through the pressure chambers 10 and apertures 12 which have a substantially rhombic plan shape and constitutes the plurality of individual ink flow paths 32 which will be described later. All of the individual ink flow paths 32 are configured by flow path components (for example, the pressure chamber 10 and the aperture 12) which are identical in shape and size, and the lengths of flow paths from the outlets of the submanifold flow paths 5*b* to the nozzles 8 are equal to each other. According to the configuration, the ink is evenly supplied from the submanifold flow paths 5*b* to the plurality of pressure chambers 10. Nozzles 8 included in four nozzle rows 8*a*, which are adjacent to one another with respect to the second direction, communicate with the same submanifold flow path 5*b*. Each of the submanifold flow paths 5*b* is connected to the same number of pressure chambers 10. In the same manner as the nozzles 8, the pressure chambers 10 constitute four pressure chamber rows in total in which two rows are disposed in each of the sides across the common submanifold flow path 5*b*. The pressure chambers 10 which belong to the inner two rows are overlapped with the submanifold flow path 5*b* in a plan view except a part of the side of the nozzles. The pressure chambers 10 which belong to the outer two rows are overlapped with the submanifold flow path in a part of the side opposite to the nozzles 8. In the second direction, four pressure chambers 10 which are adjacent to one another are formed at positions which are point-symmetric about the middle of the submanifold flow path 5*b* In the first direction, the four pressure chambers 10 which are adjacent to one another are placed in a four-row zigzag manner. Therefore, the individual ink flow paths 32 are arranged at high density in the flow path unit 4. Accordingly, an influence of crosstalk due to pressure waves in the pressure chambers 10 can be equalized. In FIG. 3, in order to facilitate the understanding of the drawing, the actuator units 21 are drawn by two-dot chain lines. The pressure chambers 10 (the pressure camber groups 90) and apertures 12, which are below the actuator units 21 and to be drawn by broken lines, are drawn by solid lines.

The nozzles 8 of the flow path unit 4 are formed at positions such that projection points are aligned at regular intervals with 600 dpi. The projection points are obtained by projecting the nozzles 8 onto a virtual line extending in the sheet width direction (perpendicular to the sheet conveying direction) in a direction perpendicular to the virtual line. In the sheet conveying direction, two nozzles 8 at corresponding positions of adjacent ones of the actuator units 21 are placed so as to be separated by an integer multiple of the distance of adjacent pixels in the case where printing is performed with 600 dpi.

The sectional structure of the head body 13 will be described. As shown in FIG. 4, the head body 13 is configured by bonding the flow path unit 4 to the actuator unit 21. The flow path unit 4 has a stacked structure in which a cavity plate 22, a base plate 23, an aperture plate 24, a supply plate 25, manifold plates 26, 27, 28, a cover plate 29 and a nozzle plate 30 are stacked together beginning at the top.

The cavity plate 22 is a metal plate in which substantially rhombic holes functioning as the pressure chambers 10 are formed. The base plate 23 is a metal plate in which communication holes through which the pressure chambers 10 communicate with the corresponding apertures 12 and communication holes through which the pressure chambers 10 communicate with the corresponding nozzles 8 are formed.

The aperture plate 24 is a metal plate in which holes functioning as the apertures 12 and communication holes through which the pressure chambers 10 communicate with the corresponding nozzles 8 are formed in a large number. The supply plate 25 is a metal plate in which communication holes through which the apertures 12 communicate with the submanifold flow paths 5*b* and communication holes through which the pressure chambers 10 communicate with the corresponding nozzles 8 are formed in a large number. The manifold plates 26, 27 and 28 are metal plates in which holes functioning as the submanifold flow paths 5*b* and communication holes through which the pressure chambers 10 communicate with the corresponding nozzles 8 are formed in a large number. The cover plate 29 is a metal plate in which communication holes through which the pressure chambers 10 communicate with the corresponding nozzles 8 are formed in a large number. The nozzle plate 30 is a metal plate in which the nozzles 8 are formed in a large number. When these nine metal plates are stacked together, the submanifold flow paths 5*b* communicate with the pressure chambers 10 through the apertures 12 and the communication holes formed in the plates 23 and 25, and the pressure chambers 10 communicate with the nozzles 8 through the communication holes formed in the plates 23 to 29. Namely, the plurality of individual ink flow paths 32 extending from the submanifold flow paths 5*b* to the nozzles 8 via the pressure chambers 10 are formed in the flow path unit 4.

As shown in FIG. 5, the actuator unit 21 has a stacked structure in which four piezoelectric sheets 41, 42, 43 and 44 are stacked together. The piezoelectric sheets 41 to 44 have a thickness of about 15 μm. The thickness of the actuator unit 21 is about 60 μm. The piezoelectric sheets 41 to 44 are formed as continuous laminated flat plates which are placed over the pressure chambers 10 formed in one ink ejection region of the head body 13. The piezoelectric sheets 41 to 44 are made of a lead zirconate titanate (PZT) base ceramic material exhibiting ferroelectricity.

The individual electrode 35 having a thickness of about 1 μm is formed on the piezoelectric sheet 41 at the uppermost layer. The individual electrode 35 and a common electrode 34 which will be described later are made of a metal material such as an Ag—Pd base material. As shown in FIG. 5B, the individual electrode 35 has a substantially rhombic plan shape, and is formed so that the electrode is opposed to the pressure chamber 10 and a major portion of the electrode in a plan view is disposed within the pressure chamber 10. As shown in FIG. 3, the individual electrodes 35 are regularly arranged in a two-dimensional manner over a substantially whole area of the piezoelectric sheet 41 at the uppermost layer. The individual electrodes 35 are formed only on the surface of the actuator unit 21. Hence, only the piezoelectric sheet 41 which is the outermost layer of the actuator unit 21 includes an active region. Therefore, the deformation efficiency of unimorph deformation in the actuator unit 21 is improved.

One of acute-angle portions of the individual electrode 35 extends to a portion which is not opposed to the pressure chamber 10 in a plan view. A land 36 having a thickness of about 15 μm is formed on the vicinity of the tip end of the acute-angle portion. The individual electrode 35 and the land 36 are electrically joined to each other. The land 36 is made of gold which contains a glass frit, for example. The land 36 is a member through which the individual electrode 35 is electrically connected to the FPC 7.

The common electrode 34 having a thickness of about 2 μm and formed over the whole face of the sheet is interposed between the piezoelectric sheet 41 at the uppermost layer and the piezoelectric sheet 42 thereunder. No electrode is placed between the piezoelectric sheets 42 and 43.

The common electrode. 34 is grounded through the FPC 7 in a not-shown region. Therefore, the common electrode 34 is equally kept to the ground potential in a region corresponding to all the pressure chambers 10. The individual electrodes 35 are electrically connected via the FPC 7 to a driver IC (not shown) which is a part of the control unit 100. The potentials of the individual electrodes are selectively controlled by the driver IC.

Hereinafter, the operation of the actuator unit 21 will be described. In the actuator unit 21, among the four piezoelectric sheets 41 to 44, only the piezoelectric sheet 41 is polarized in the direction from the individual electrode 35 to the common electrode 34. When a predetermined potential is applied to the individual electrode 35 by the driver IC, a potential difference is produced in a region (active region) of the piezoelectric sheet 41 sandwiched between the individual electrode 35 to which the predetermined potential is applied, and the common electrode 34 held to the ground potential. By the potential difference, an electric field in the thickness direction is generated in the portion of the piezoelectric sheet 41, and the portion of the piezoelectric sheet 41 is contracted by the piezoelectric transverse effect in a direction perpendicular to the polarization direction. An electric field is not applied to the other piezoelectric sheets 42 to 44. Therefore, the piezoelectric sheets 42 to 44 are not contracted in this way. Therefore, unimorph deformation, which is convex toward the pressure chamber 10, is produced as a whole in the portions of the piezoelectric sheets 41 to 44 opposed to the active region.

As a result, the volume of the pressure chamber 10 is reduced to increase the pressure of the ink, and the ink is ejected from the nozzle 8 shown in FIG. 4. When the individual electrode 35 is then returned to the ground potential, the piezoelectric sheets 41 to 44 are returned to their original shapes. The volume of the pressure chamber 10 is also returned to the original one. Therefore, the ink is sucked from the submanifold flow path 5*b* into the individual ink flow path 32.

As another driving method, there is a method in which a predetermined potential is previously applied to the individual electrode 35, the individual electrode 35 is once set to the ground potential each time when an ejection request is issued, and thereafter the predetermined potential is again applied to the individual electrode 35 at a given timing. In the method, the piezoelectric sheets 41 to 44 are returned to their original states at the timing when the individual electrode 35 is set to the ground potential, the volume of the pressure chamber 10 is increased as compared with the initial state (where the voltage is previously applied), and the ink is sucked from the submanifold flow path 5*b* into the individual ink flow path 32. At the timing when the predetermined potential is again applied to the individual electrode 35, the portions of the piezoelectric sheets 41 to 44 opposed to the active region are deformed so as to be convex toward the pressure chamber 10, the pressure of the ink is raised by reduction of the volume of the pressure chamber 10, and the ink is ejected from the nozzle 8.

In the first embodiment described above, the four actuator units 21 are placed so that the long sides of the contours of the actuator units are inclined with respect to the contour lines 4*a* of the flow path unit 4, and the centers of gravity of the contours are positioned on the straight line L1 which is parallel to the contour lines 4*a*.

Accordingly, the four actuator units 21 can be disposed within the range between straight lines L2 and L3 parallel to the contour lines 4*a* with respect to the direction perpendicular to the contour lines 4*a*. Even when the flow path unit is prolonged and the number of the actuator units 21 is increased, it is not necessary to change the length of the flow path unit 4 in the direction perpendicular to the contour lines 4*a*. Accordingly, the plan shape of the head body 13 can be made small.

Since the long sides of the contour of the actuator unit 21 are parallel to the sheet width direction, the nozzle rows 8*a* extend in parallel to the sheet width direction. When the plurality of nozzles 8 belonging to one nozzle row 8*a* eject the ink at the same timing, printing can be performed on the printing sheet P. Accordingly, in the process of printing, it is requested only to apply a pressure at the timing to the inks in the plurality of pressure chambers 10 communicating with the plurality of nozzles 8 belonging to one nozzle row 8*a*, and the control of the actuator unit 21 is simplified. In two adjacent actuator units 21, two nozzles 8 at corresponding positions in the image formation are placed so as to be separated by an integer multiple of the distance of adjacent pixels in the case where printing is performed with 600 dpi. Moreover, all the nozzle rows 8*a* are placed in parallel to the direction perpendicular to the sheet conveying direction. Therefore, the four actuator units 21 can be driven at the same timing. Hence, the control of the actuator units 21 is further simplified.

In the regions respectively interposed between adjacent actuator units 21, the manifold flow path 5*a* extends in the second direction, and the submanifold flow paths 5*b* branch from the manifold flow path 5*a* and extend in the sheet width direction in correspondence with the nozzle rows 8*a*. Therefore, the ink can be evenly supplied to all the pressure chambers 10.

In the second direction, the four pressure chambers 10 which are commonly adjacent to the submanifold flow path 5*b* are placed in the relationship in which they are point-symmetric about the middle of the submanifold flow path 5*b*.

In the first direction, the four pressure chambers 10 placed in a four-row zigzag manner. With respect to the submanifold flow path 5*b*, the nozzles 8 which are at symmetric positions respectively on the both sides communicate with the opposite acute-angle portions of the pressure chambers 10. Between the nozzle rows 8*a* which are arranged in this manner, the submanifold flow paths 5*b* extend. For the number of the nozzle rows 8*a*, the submanifold flow paths 5*b* are ensured to have a large width. Therefore, the inks are properly distributed from the submanifold flow paths 5*b* to the pressure chambers 10 which are arranged at high density.

Furthermore, the numbers of the pressure chambers 10 communicating with the respective submanifold flow paths 5*b* are equal to each other. Accordingly, the influence of crosstalk due to pressure waves in the pressure chambers 10 can be equalized.

Next, modifications in which various changes are made on the first embodiment will be described. Components identical with those of the first embodiment are denoted by the same reference numerals, and their description is often omitted.

Figure 6:
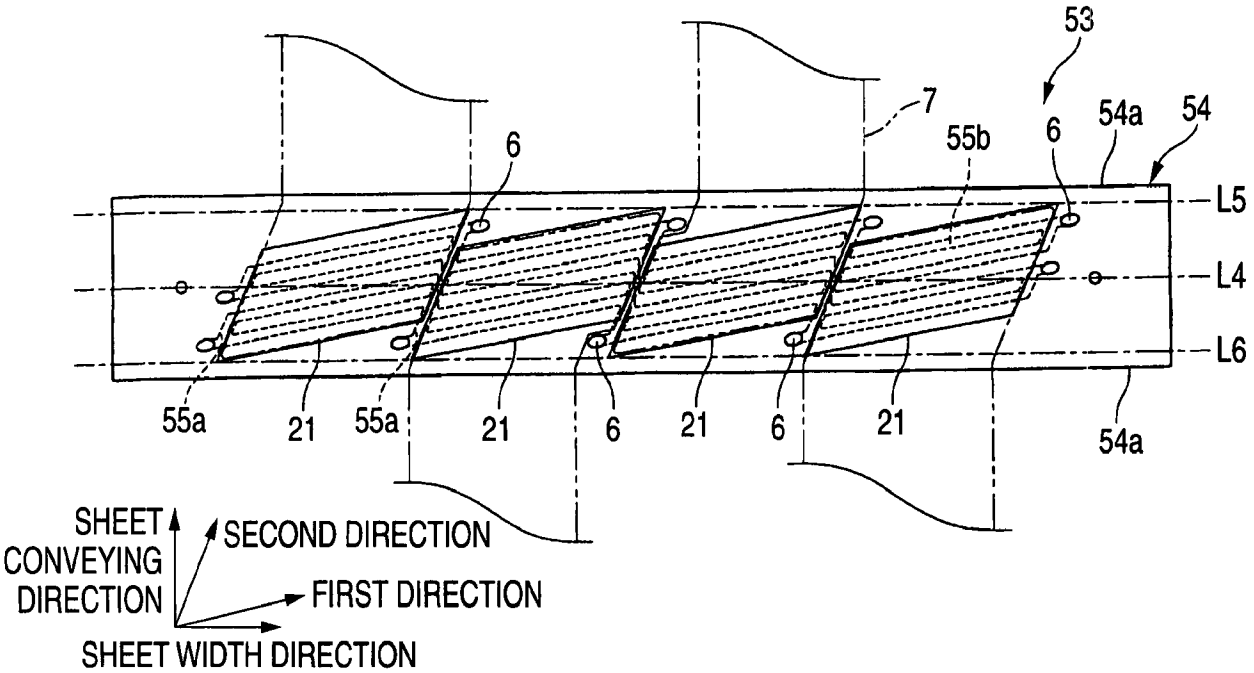
FIG. 6 is a plan view of a first modified aspect corresponding to FIG. 2.

In one modification, as shown in FIG. 6, a flow path unit 54 has a substantially rectangular plan shape having contour lines 54*a* which are parallel to the sheet width direction. The long sides of the actuator units 21 extend in the first direction which is inclined to the sheet width direction (First Modified Embodiment). FIG. 6 is a plan view of the first modified embodiment corresponding to FIG. 2. In this case, the plan shape of the flow path unit 54 is substantially rectangular. Hence, the inkjet head 2 can be easily mounted on the inkjet printer 2 (see FIG. 1).

In the same manner as the first embodiment, the centers of gravity of the contours of the four actuator units 21 are positioned on a straight line L4 which is parallel to the contour lines 54*a*. The four actuator units 21 are disposed within the range between two straight lines L5 and L6 which are parallel to the contour lines 54*a* with respect to the direction (sheet conveying direction) perpendicular to the contour lines 54*a*. Even when the number of the actuator units 21 is increased, it is not necessary to increase the width of the flow path unit 54 in the sheet conveying direction. Accordingly, the plan shape of the head body 53 can be made small.

In this case, a manifold flow path 55*a* extends in the second direction, and submanifold flow paths 55*b* extend in the first direction. Therefore, the nozzle rows 8*a* (see FIG. 3) are not parallel to the sheet width direction. However, projection points which are obtained by projecting the nozzles 8 onto a virtual straight line extending in the sheet width direction are arranged at equal intervals corresponding to the resolution of printing. In this case, when the inclination of the nozzle rows 8*a* with respect to the sheet width direction (the arrangement of the nozzles 8 along the first direction) is considered, the interval of adjacent nozzles 8 in a nozzle row 8*a* can be made larger than that of projection points formed by the two nozzles 8.

When the nozzles 8 are arranged at the same intervals as the above-described embodiment, printing can be performed at higher resolution than that in the above-described embodiment. This modified embodiment may be suitable for high resolution. Since the nozzle rows 8*a* are arranged while being inclined with respect to the sheet width direction, the inks of the pressure chambers 10 which communicate with the same submanifold flow path 5*b* and are placed in close proximity to each other are not pressurized at the same timing. Accordingly, crosstalk due to pressure waves can be further suppressed.

In this modified embodiment, in the same manner as the first embodiment described above, the ink supply ports 6 are arranged along the two contour lines 54*a* of the flow path unit 54. The manifold flow paths 5*a* and 55*a* communicate with the ink supply ports 6. That is, this modified embodiment is configured such that one inkjet head 2 ejects the ink of one color. In FIG. 2, for example, the ink supply ports 6 are separated into a group where the ports are close to the upper contour line 4*a* and where the ports are close to the lower contour line 4*a*, and the groups do not communicate with each other. Alternatively, in FIG. 6, the ink supply ports 6 are separated into a group where the ports are close to the upper contour line 54*a* and where the ports are close to the lower contour line 54*a*, and the groups do not communicate with each other. According to the configuration, one inkjet head 2 can eject inks of two colors without largely changing the flow paths other than the manifold flow path 5*a* and 55*a*.

Figure 7:
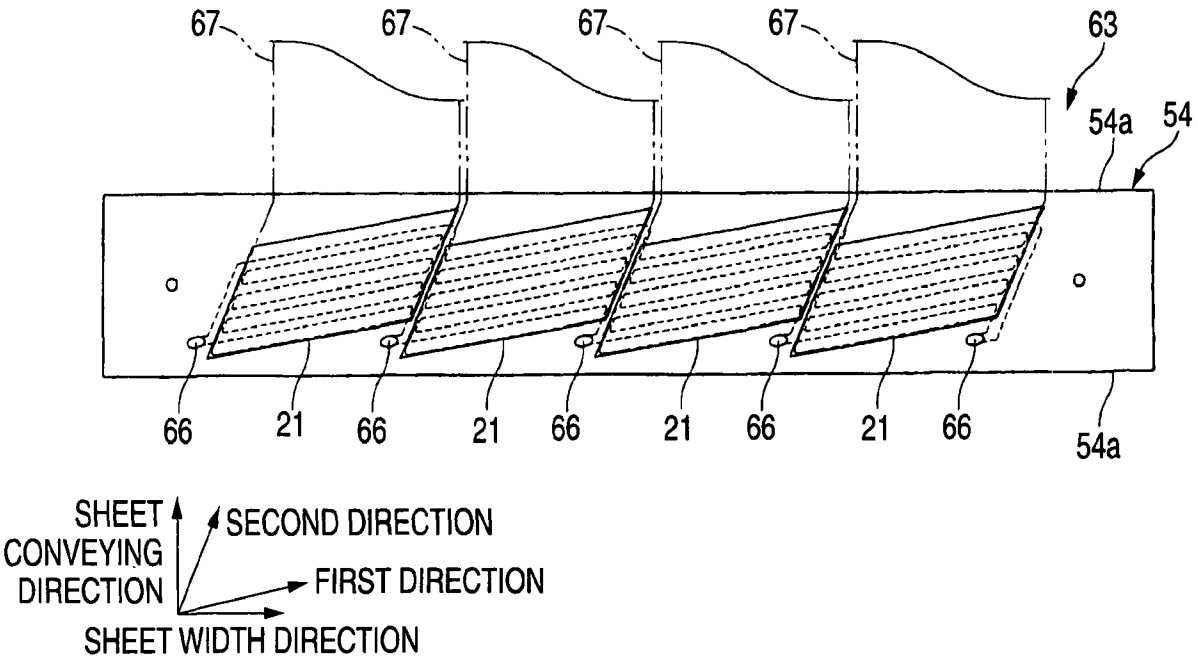
FIG. 7 is a plan view of a second modified aspect corresponding to FIG. 2.

In another modified embodiment, as shown in FIG. 7, ink supply ports 66 are arranged along only one (the lower one in FIG. 7) of the two contour lines 54*a* of the flow path unit 54. Four FPCs 67 placed on the upper faces of the four actuator units 21 are led out to the side (upper side in FIG. 7) opposite to the ink supply ports 66 of the flow path unit 54 (Second Modified Embodiment). FIG. 7 is a plan view of the second modified embodiment corresponding to FIG. 2. In this case, the ink supply ports 66 are not formed in the vicinities of portions from which the FPCs 67 are led out. Therefore, the FPCs 67 can be led out without reducing the width or at the same width as the long sides of the contour of the actuator unit 21. Further, the FPCs 67 are led out only from one side of the flow path unit 54.

Thus, the head body 13 can be moved in a relatively free manner even after the FPCs 67 are connected to an external wiring board or the like. Therefore, the production of the inkjet head 2 is facilitated. When the actuator unit 21 and the corresponding FPC 67 are considered as a set of components, it is requested only to prepare a required number of same sets. This commonality of components contributes to high productivity and reduction of the production cost.

Figure 8:
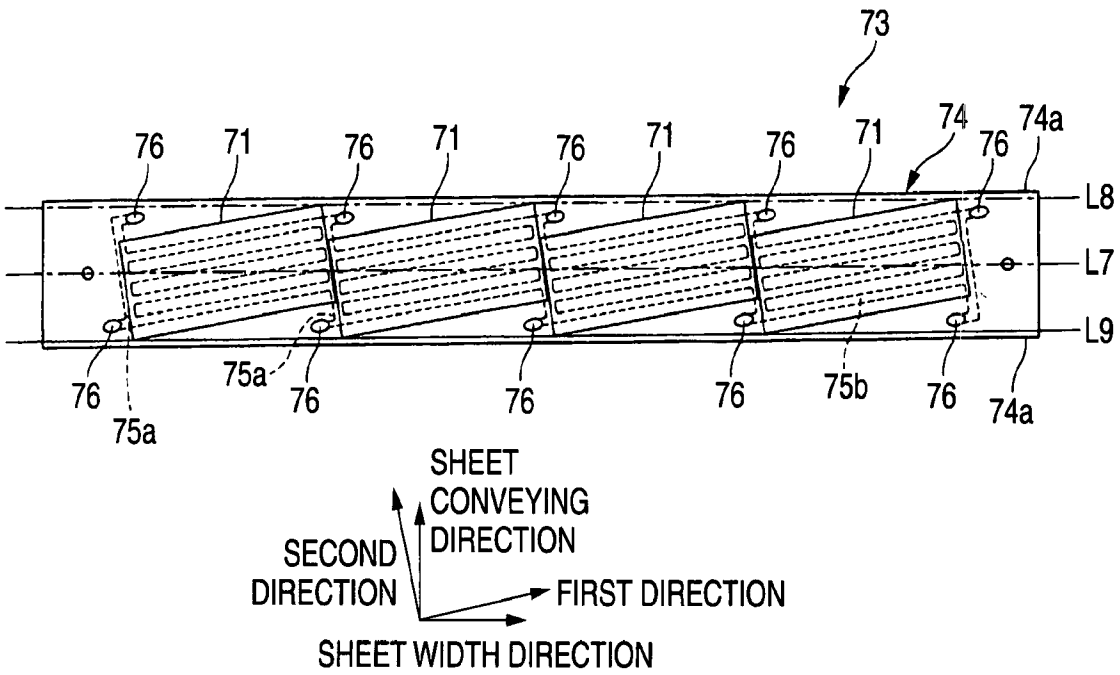
FIG. 8 is a plan view of a third modified aspect corresponding to FIG. 2.

In another modified embodiment, as shown in FIG. 8, actuator units 71 have a substantially rectangular contour (Third Modified Embodiment). FIG. 8 is a plan view of the third modified embodiment corresponding to FIG. 2. Also in this case, the long sides of the contours of the four actuator units 71 extend in the first direction which is inclined with respect to the sheet width direction The centers of gravity of the contours are positioned on a straight line L7 which is parallel to contour lines 74*a*. The four actuator units 71 are disposed within the range between two straight lines L8 and L9 which are parallel to contour lines 74*a* with respect to the direction (sheet conveying direction) perpendicular to the contour lines 74*a*. Even when the number of the actuator units 71 is increased, it is not necessary to prolong the length of the flow path unit 74 with respect to the sheet conveying direction. Accordingly, the plan shape of the head body 73 can be made small. Alternatively, the actuator unit may have a rhombic plan shape.

Second Embodiment

Figure 9:
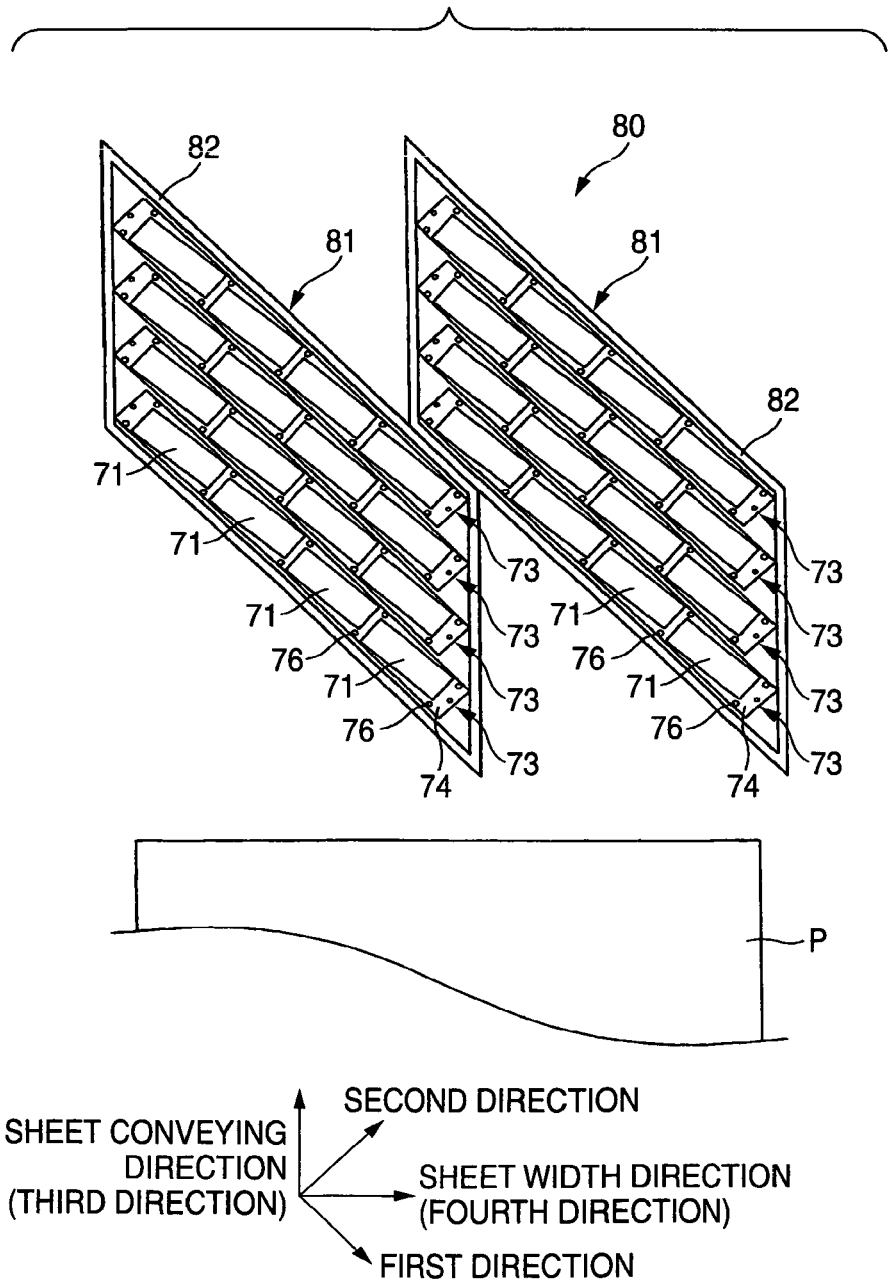
FIG. 9 is a plan view of an inkjet head assembly of a second aspect.

Next, a second embodiment will be described with reference to FIG. 9. FIG. 9 is a plan view of an inkjet head assembly of the second embodiment. According to the second embodiment, in the inkjet printer 1 (see FIG. 1) same as that of the first embodiment, an inkjet head assembly 80 such as shown in FIG. 9 is disposed in place of the four inkjet heads 2.

As shown in FIG. 9, the inkjet head assembly 80 is configured by arranging two inkjet head subassemblies 81 in the sheet width direction (the lateral direction of FIG. 9). Each of the inkjet head subassemblies 81 has four inkjet heads each having the head body 73 (see FIG. 8), and a frame (fixing member) 82 for fixing the four head bodies 73.

The head bodies 73 have the same structure as that of the third modified embodiment of the first embodiment. Thus, detailed description thereof is omitted. In FIG. 9, a manifold flow path 75*a* and submanifold flow paths 75*b* are not shown in FIG. 9. In each of the head bodies 73, the contour lines 74*a* of the flow path unit 74 extend in the direction (first direction) which is inclined with respect to the sheet width direction. The four head bodies 73 are arranged in the sheet conveying direction (the vertical direction of FIG. 9). The four inkjet heads eject inks of different colors or of magenta (M), yellow (Y), cyan (C) and black (B), respectively.

The frame 82 is a substantially parallelogram-like frame which has one set of opposing sides extending in the sheet conveying direction, and another one set of opposing sides extending in the first direction. The four head bodies 73 are fitted into the frame. Thus, the bodies are fixed to the frame 82. When the four head bodies 73 are fixed to the frame 82, their corresponding positions are arranged in the sheet conveying direction (third direction). One inkjet head subassembly can perform color printing by inks of the four colors on the portion where the inkjet head subassembly is placed, in the sheet width direction of the printing sheet P. When the plan shape is formed into a parallelogram which is parallel to the first direction and to the sheet conveying direction, the frame 82 for fixing the four head bodies 73 can be made small.

The inkjet head assembly 80 is configured by arranging the two inkjet head subassemblies 81 with respect to the sheet width direction. The long sides of the frames 82 which are adjacent with respect to the sheet width direction partly overlap with each other. When the inkjet head assembly 80 is configured in this manner, the head bodies 73 are placed over the whole printing region of the printing sheet P with respect to the sheet width direction.

When the head bodies 73 eject inks while the printing sheet P is conveyed in the sheet conveying direction, color printing can be performed on the printing sheet P. The corresponding positions of the two inkjet head subassemblies 81 coincide with each other. Thus, the two inkjet head subassemblies 81 can be driven at the same timing. Therefore, the control of the inkjet head assembly 80 is facilitated.

Next, modifications in which various changes are made on the second embodiment will be described.

According to the second embodiment, in each of the inkjet head subassemblies 81, the four head bodies 73 are arranged in the frame 82. Alternatively, in accordance with the kinds of inks to be ejected, a plurality of head bodies 73, the number of which is other than four, may be arranged in the sheet conveying direction.

In the second embodiment, the inkjet head assembly 80 is configured by the two inkjet head subassemblies 81. Alternatively, in accordance with the width (length in the sheet width direction) of the printing sheet P, three or more inkjet head subassemblies 81 may be arranged in the sheet width direction, whereby the inkjet head assembly is configured.

In the second embodiment, in order to perform color printing, the four head bodies 73 belonging to the inkjet head subassembly 81 are arranged so that their corresponding positions coincide with one another with respect to the sheet width direction. Alternatively, the four head bodies 73 may eject inks of the same color, and the corresponding positions of the four head bodies 73 may be shifted from one another with respect to the sheet width direction. In the alternative, monochromatic printing of higher resolution than that which can be obtained by printing using the head body 73 can be performed.

In the second embodiment, the head bodies 73 of the third modified embodiment of the first embodiment are used.

The embodiment is not restricted to this, and may use the head bodies (see FIGS. 2, 6 and 7) of the first embodiment and the first and second modified embodiments thereof.

According to the aspects of the invention, the plurality of actuator units are placed such that the opposing sides of the contour of each actuator unit, which are parallel to the first direction, are inclined with respect to the contour lines of the flow path unit. The centers of gravity of the contours of the plurality of actuator units are arranged on one straight line which is parallel to the contour lines of the flow path unit. With respect to the direction perpendicular to the contour lines of the flow path unit, the plurality of actuator units can be disposed within a given range irrespective of the number of the actuator units. Even when the flow path unit is prolonged and a large number of actuator units are disposed, it is not necessary to make the inkjet head long in the direction perpendicular to the longitudinal direction of the flow path unit. Thus, the plan shape of the inkjet head can be made small.

According to the aspects of the invention, when the conveying direction is not perpendicular to the first direction, the arrangement direction of the plurality of pressure chambers fails to coincide with the width direction of the recording medium perpendicular to the conveying direction. Therefore, timings when the pressure is applied by the actuator units to the pressure chambers arranged in the first direction must be adjusted in accordance with the inclination angle between the directions. Hence, the control of piezoelectric actuators is complicated. On the other hand, if the conveying direction is perpendicular to the first direction, the width direction of the recording medium perpendicular to the conveying direction coincides with the first direction which is the arrangement direction of the ink ejection ports. Therefore, printing can be performed while pressurizing at the same timings the plurality of pressure chambers arranged in the first direction. When the shift amounts of the actuator units are adjusted during the step of placing the actuator units, printing can be performed while pressurizing at the same timings the pressure chambers which are at corresponding positions in all the actuator units. Therefore, the control of the actuator units is facilitated.

According to the aspects of the invention, the extension direction of the flow path unit is perpendicular to the conveying direction of the recording medium. Hence, the inkjet head can be easily mounted on the inkjet printer. In the case where the plurality of branch ink chambers extend in the first direction, pressure chambers communicating with one branch ink chamber are not arranged in the width direction of the recording medium perpendicular to the conveying direction. Therefore, pressure chambers which communicate with the same common ink chamber and are in close proximity to each other are not pressurized at the same timing. Thus, crosstalk due to pressure waves can be suppressed.

According to the aspects of the invention, the plurality of inkjet heads are placed in the third direction. Accordingly, it is possible to easily configure an inkjet head subassembly which can perform high resolution printing when inks of the same color are ejected from the inkjet heads and can perform multicolor printing when inks of different colors are ejected from the inkjet heads.

According to the aspects of the invention, the plurality of inkjet head subassemblies are arranged in the fourth direction. Accordingly, the inkjet head assembly which can simultaneously eject inks can be easily configured in a region extending in the fourth direction.

According to the aspects of the invention, the arrangement direction of the plurality of inkjet head subassemblies is made coincident with the width direction of the recording medium by placing the inkjet head assembly such that the fourth direction is perpendicular to the conveying direction. Therefore, printing can be performed while pressurizing at the same timings pressure chambers which are at corresponding positions in the inkjet head subassemblies. Accordingly, the control of the actuator units is facilitated.

According to another aspect of the invention, the parallelograms of the plurality of actuator units have a same size. According to still another aspect of the invention, a plurality of ink supply ports are formed along only one of the two contour lines. According thereto, the ink supply ports are formed along only one of the two contour lines of the flow path unit. Therefore, wirings for supplying a driving voltage to the actuator units can be led out only from the side of the flow path unit opposite to the ink supply ports. Accordingly, structure of the inkjet head is simplified. Since the wirings are led out only in one direction, the flow path unit and the actuator units can be moved in a relatively free manner even after the wirings are connected to an external wiring board or the like. Therefore, the inkjet head can be easily produced.

According to still another aspect of the invention, the common ink chamber includes: a main ink chamber which communicates with the ink supply port; and a branch ink chamber which branches from the main ink chamber and communicates with the plurality of pressure chambers, wherein the branch ink chamber extends in the first direction in correspondence with each of the actuator units, and wherein a plurality of branch ink chambers are provided in parallel to the second direction. According thereto, the ink can be evenly supplied to the pressure chambers corresponding to the plurality of actuator units.

According to still another aspect of the invention, the main ink chamber extends in the second direction and is interposed between adjacent actuator units, and the plurality of branch ink chambers branch to both sides of the main ink chamber extend in the first direction. According thereto, the ink can be evenly supplied to all the pressure chambers. Thus, insufficient ink supply can be eliminated.

According to still another aspect of the invention, each of the plurality of branch ink chambers is communicated with respective pressure chambers. According thereto, the number of the pressure chambers connected to the respective branch ink chambers are equal to each other.

Accordingly, influence of crosstalk due to pressure waves in the pressure chambers can be equalized.

According to still another aspect of the invention, the inkjet head subassembly, a contour of the fixing member has a parallelogram shape which is defined by a pair of opposing sides parallel to the contour lines and a pair of opposing sides parallel to the third direction when seen from the direction perpendicular to the plane. According thereto, a size of the fixing member can be reduced.

What is claimed is:

1. An inkjet head subassembly comprising:

a plurality of inkjet heads, a fixing member which fixes the plurality of inkjet heads; and wherein the each of the plurality of the inkjet head includes:

a plurality of pressure chamber groups each including a plurality of pressure chambers, wherein each of the pressure chambers which communicate with respective ink ejection ports and are arranged in a matrix pattern in a first direction and a second direction within the pressure chamber group, wherein each of the pressure chamber groups has a non-rectangle parallelogram region defined by a first set of opposing sides, which extends along the first direction, and a second set of opposing sides, which extends along the first direction, the first sets of opposing sides being parallel to one another, the second sets of opposing sides being parallel to one another, and wherein each of the plurality of inkjet heads has a first set of opposing contours and a second set of opposing contours, wherein the plurality of inkjet heads are arranged along a third direction, which intersects with each of the first direction, the second directions, the first set of opposing contours and the second set of opposing contours, by the fixing member.

2. The inkjet head subassembly according to claim 1, wherein a contour of the fixing member has a non-rectangle parallelogram shape which is defined by a third set of opposing contours and a fourth set of opposing contours, wherein the third set of opposing contours of the fixing member is parallel to the first set of opposing contours of the inkjet head, and wherein the fourth set of opposing contours is parallel to the third direction when seen from the direction perpendicular to the plane.

3. An inkjet head assembly comprising a plurality of the inkjet head subassemblies according to claim 2, wherein the plurality of inkjet head subassemblies are arranged along a fourth direction which intersects with each of the first direction, the second direction, the third direction and the contour lines.

4. An inkjet printer comprising a plurality of the inkjet head assemblies according to claim 3, wherein the inkjet printer performs printing on a recording medium conveyed in a predetermined conveying direction, and wherein the inkjet head assembly is placed such that the fourth direction and the conveying direction are substantially perpendicular to each other.

5. The inkjet head subassembly according to claim 2, wherein the first set of the opposing contours is parallel to the first direction.

6. The inkjet head subassembly according to claim 2, wherein the first set of the opposing contours intersects with the first direction.

* * * * *